US006601369B2

(12) United States Patent
Spatafora et al.

(10) Patent No.: US 6,601,369 B2
(45) Date of Patent: Aug. 5, 2003

(54) METHOD AND UNIT FOR CLOSING THE ENDS OF TUBULAR WRAPPINGS ON A CIGARETTE PACKING MACHINE

(75) Inventors: Mario Spatafora, Bologna (IT); Loris Grepioni, Castel Maggiore (IT)

(73) Assignee: G.D. Societa' Per Azioni, Via Pomponia (IT)

( * ) Notice: Subject to any disclaimer, the term of this patent is extended or adjusted under 35 U.S.C. 154(b) by 48 days.

(21) Appl. No.: 09/850,009

(22) Filed: May 7, 2001

(65) Prior Publication Data

US 2002/0050128 A1 May 2, 2002

(30) Foreign Application Priority Data

May 8, 2000 (IT) ..... BO2000A0258

(51) Int. Cl.[7] ..... B65B 11/00; B65B 11/28
(52) U.S. Cl. ..... 53/466; 53/234
(58) Field of Search ..... 53/234, 377.2, 53/378.3, 466, 491

(56) References Cited

U.S. PATENT DOCUMENTS 3,810,314 A 5/1974 Anderson
4,736,569 A * 4/1988 Hudson et al. ..... 53/377.2
4,845,924 A * 7/1989 Focke et al. ..... 53/234

FOREIGN PATENT DOCUMENTS

EP 0 845 416 A 6/1998
FR 718 291 A 1/1932

* cited by examiner

*Primary Examiner*—Stephen F. Gerrity
(74) *Attorney, Agent, or Firm*—Marshall, Gerstein & Borun

(57) ABSTRACT

A method and unit for closing the ends of tubular wrappings on a cigarette packing machine, wherein the tubular wrappings enclosing respective groups of cigarettes are fed continuously and successively along an annular path and through two folding stations, in the first of which a movable folding member and a fixed folding member, common to all the tubular wrappings, fold the short sides of a projecting tubular portion of the tubular wrapping to define two projecting major tabs, and in the second of which a single rocker arm, common to all the tubular wrappings, is swung to successively fold the two major tabs while the wall of the tubular wrapping coplanar with each major tab is maintained, during folding, contacting a respective flat supporting wall.

52 Claims, 6 Drawing Sheets

METHOD AND UNIT FOR CLOSING THE ENDS OF TUBULAR WRAPPINGS ON A CIGARETTE PACKING MACHINE

The present invention relates to a method of closing the ends of tubular wrappings on a cigarette packing machine.

In particular, the present invention relates to a method of closing the ends of tubular wrappings on a continuously operating cigarette packing machine. In the following description, reference is made solely to closing the ends of inner wrappings of so-called "rigid" packets of cigarettes, though, as will be clear to an average technician in this particular field, the same also applies equally to closing the ends of outer wrappings of so-called "soft" packs.

BACKGROUND OF THE INVENTION

On continuously operating cigarette packing machines, groups of cigarettes are fed successively to respective conveying heads on a wrapping wheel unit, to which each group is supplied already partly wrapped in a respective sheet of wrapping material, normally foil, folded into a U about the group. As it is fed forward on the wrapping unit, each sheet of wrapping material is folded longitudinally at a folding station to form about the respective group a tubular wrapping having two end portions, each projecting from a respective end of the group, and each of which is later folded, at further folding stations, to close the end of the relative tubular wrapping.

On the wrapping unit wheels of known continuously operating packing machines, the tubular wrappings, as they are fed through the folding stations by the respective conveying heads, are normally maintained contacting the conveying heads by means of a cylindrical outer plate, which slides along, and so outwardly curves, an outer wall of each tubular wrapping. At relatively high production speeds, the fact that one of the walls on the tubular wrapping is curved may result, when closing the ends of the tubular wrapping, in improper folding of the end portions, thus resulting in the group being rejected.

U.S. Pat. No. 3,810,314 discloses a packing machine, wherein tubular wrappings are fed successively along a straight folding path and through two folding stations, in the first of which the short sides of a projecting tubular portion of each tubular wrapping are folded to define two projecting major tabs, and in the second of which the two major tabs are folded one towards the other. The straight folding path is defined by lateral fixed folding means and by upper and lower fixed supporting means, which contact the major walls of each tubular wrapping when such tubular wrapping is fed along the straight folding path.

However, the packing machine disclosed by U.S. Pat. No. 3,810,314 can be used only at relatively low production speeds, because when each tubular wrapping is fed along the straight folding path, the relevant major walls creep along the upper and lower fixed supporting means.

SUMMARY OF THE INVENTION

It is an object of the present invention to provide a method of closing the ends of tubular wrappings designed to eliminate the aforementioned drawback, and which is also straightforward and cheap to implement.

According to the present invention, there is provided a method of closing the ends of tubular wrappings enclosing respective groups of cigarettes.

In the method defined above, said two tabs are preferably folded as the relative said tubular wrapping is fed along a path parallel to said major walls; both said tabs being folded successively by means of a single rocker arm mounted to swing about a hinge axis crosswise to said path and comprising two arms located on opposite sides of said hinge axis and each having a respective folding edge for a respective said tab; said rocker arm being swung about said hinge axis so that each said folding edge interferes with said path in time with said tubular wrappings traveling along the path.

Using a rocker arm as described above in itself provides for solving another important problem encountered on most known continuously operating wrapping wheels, and which is the highly complicated mechanical design, and therefore relatively poor reliability and high manufacturing and maintenance cost, of such wheels. Known continuously operating wrapping wheels, in fact, normally feature an outer folding device common to all the conveying heads and for folding one of the major tabs of each end portion of each tubular wrapping, and a number of inner folding devices, each fitted to and movable with respect to a respective conveying head. As a result, the wrapping wheel must be fitted with mechanisms for controlling the inner folding devices, and which, being normally both complicated and bulky, further complicate the already complex structure of the wrapping wheels.

Using a rocker arm as described above, on the other hand, provides for eliminating all the inner folding devices, and for folding both the major tabs of each end portion of each tubular wrapping using one outer folding member.

The present invention also relates to a unit for closing the ends of tubular wrappings.

According to the present invention, there is provided a unit for closing the ends of tubular wrappings enclosing respective groups of cigarettes.

BRIEF DESCRIPTION OF THE DRAWINGS

A non-limiting embodiment of the present invention will be described by way of example with reference to the accompanying drawings, in which.

DETAILED DESCRIPTION OF THE INVENTION

Figure 8A:
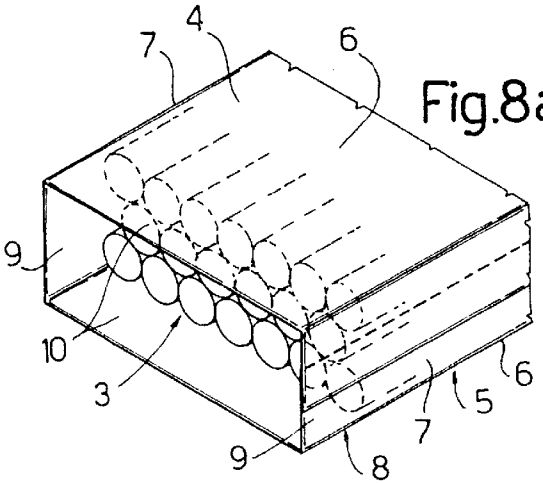
FIGS. 8*a*, 8*b*, 8*c*, and 8*d* show enlarged partial isometric views of a succession of folding steps performed on the wrapping unit in FIGS. 1 to 5.
Figure 8C:
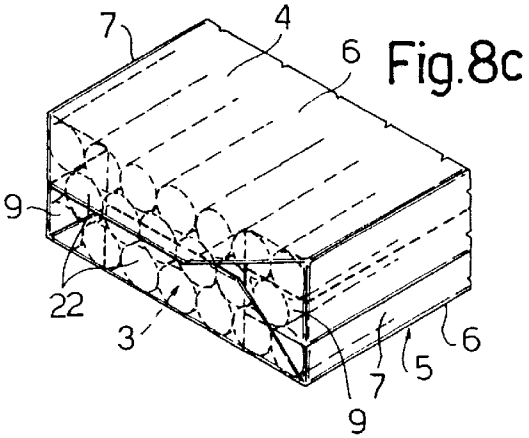
Figure 8B:
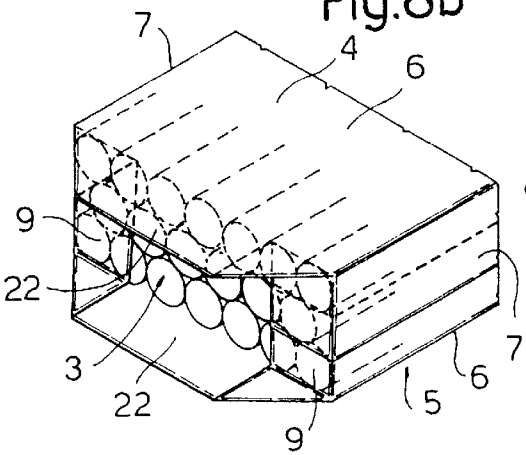
Figure 8D:
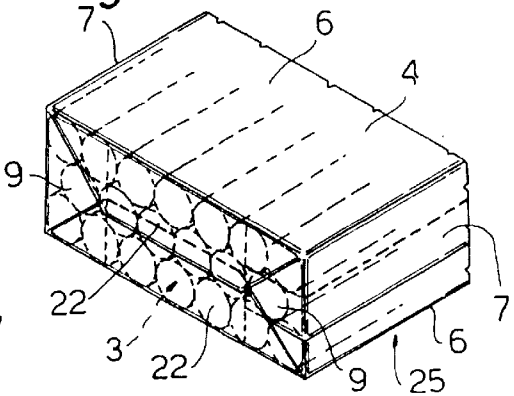

With reference to one of FIGS. 1 to 5, number 1 indicates as a whole a continuously operating cigarette packing machine comprising a wrapping unit 2 for successively receiving groups 3 of cigarettes, each enclosed in a respective sheet 4 of wrapping material folded about group 3 to define a tubular wrapping 5. As shown more clearly in FIG. 8*a,* each tubular wrapping 5 comprises two major walls 6, two minor walls 7 perpendicular to major walls 6, and at least one substantially rectangular-section tubular end portion 8.

When, as in the example shown, sheet 4 of wrapping material is a sheet of foil directly contacting the cigarettes in the relative group 3, there are two opposite tubular portions 8; whereas, when sheet 4 of wrapping material is used to form the outer wrapping of a soft pack (not shown), there may be only one tubular portion 8.

Tubular end portion 8 projects axially with respect to relative group 3, and comprises two short sides 9 coplanar with respective minor walls 7, and two long sides 10 coplanar with respective major walls 6.

Wrapping unit 2 comprises a wrapping wheel 11 mounted to rotate about a respective axis 12 (FIG. 1) and rotated at substantially constant angular speed about axis 12 by a motor 13. Wrapping wheel 11 comprises a number of known conveying heads 14 equally spaced about, and each positioned radially with respect to, axis 12. Each conveying head 14 is fitted to wrapping wheel 11 so as to swing, with respect to wrapping wheel 11, about a respective intermediate axis 15 parallel to axis 12, and comprises a flat end plate 16 defining a supporting surface for a relative group 3 of cigarettes enclosed in relative tubular wrapping 5.

Each conveying head 14 supports relative tubular wrapping 5 with minor walls 7 positioned substantially radially with respect to axis 12, with one of major walls 6 contacting plate 16 and the other facing outwards, and with the longitudinal axis of the tubular wrapping parallel to axis 12.

Each head 14 feeds relative group 3 and relative sheet 4 of wrapping material in a direction 17 (clockwise in FIGS. 1 to 5) along an annular path P extending about axis 12 and at least partly along a channel 18 defined internally by plates 16 and externally by a cylindrical plate 19 coaxial with axis 12 and which slides against an intermediate portion of the outer wall 6 of each tubular wrapping 5.

For the sake of simplicity, the following description refers to a packing machine 1 on which each tubular wrapping 5 has only one tubular portion 8, it being understood that, in the case of two portions 8, the folding devices described must be duplicated and share the relative actuating devices.

Wrapping unit 2 comprises a folding device 20 located at a folding station 21 to fold the short sides 9 of each tubular wrapping 5 onto the relative group 3 and define on the relative long sides 10 two tabs 22 coplanar wish respective major walls 6; and a further folding device 23 located at a further folding station 24, downstream from folding station 21 in direction 17, to fold tabs 22 successively onto relative group 3 and one towards the other to close the end of relative tubular wrapping 5 completely and obtain a wrapping 25 fully enclosing relative group 3.

As shown in any one of FIGS. 1 to 5, folding device 20 is located substantially outwards of path P, i.e. on the opposite side of path P to wrapping wheel 11, and comprises a motor 26, which is fitted to a frame (not shown) of packing machine 1, has a fixed axis of rotation 27 parallel to axis 12, and has an output shaft 28 coaxial with axis 27 and fitted with a crank 29 The free end of crank 29 is fitted with a pin 30 parallel to axis 12 and in turn fitted with a rod 31, which is shorter than crank 29, is superimposed on crank 29, substantially extends towards axis 27, and is fitted on the free end with a pin 32 parallel to axis 12 and defining, with shaft 28, a virtual crank 33 of a length equal to the distance between axis 27 and the axis of pin 32.

Pin 32 is connected in rotary manner to a first arm 34 of a rocker arm 35, a second arm 36 of which is curved and fitted on the free end with a movable folding member 37 facing substantially in direction 17 and of a width approximately equal to but no greater than the width of shirt sides 9 of tubular portion 8. Between arms 34 and 36, rocker arm 35 is fitted with a pin 38 parallel to axis 12 and connected in rotary manner to the free end of a further crank 39, the other end of which is connected to said frame (not shown) to rotate about a fixed axis 40 parallel to axis 12.

Virtual crank 33, arm 34 of rocker arm 35, and crank 39 define an articulated parallelogram 41, which is activated to impart to folding member 37 an active stroke—from a withdrawn rest position (FIG. 3) outwards of path P, to a forward work position (FIG. 5)—along a trajectory which extends in a plane tangent to the relative end of groups 3, is traveled at a speed slightly faster than the traveling speed of conveying heads 14, and comprises an end portion extending along path P and in direction 17.

Figure 5:
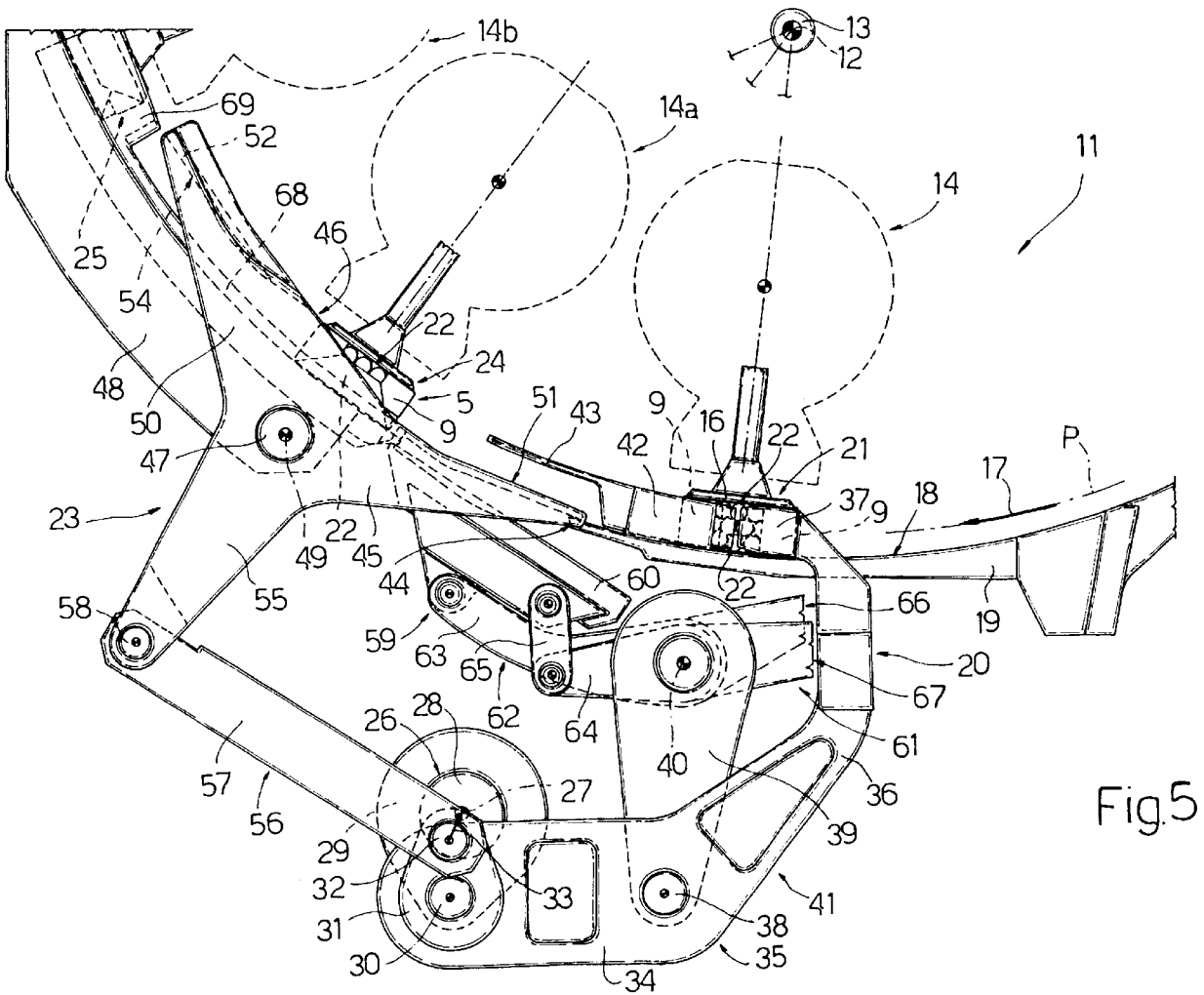
Figure 6:
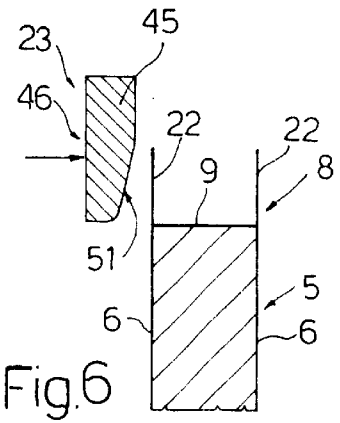
FIG. 6 shows an enlarged section along line VI—VI in FIG. 2.

Folding device 20 also comprises a fixed folding member 42, which is the same width as movable folding member 37, is located along path P in a plane tangent to the relative end of groups 3, and is so positioned that the rear end, in direction 17, substantially contacts movable folding member 37 when movable folding member 37 is in the forward work position (FIG. 5). A relatively thin appendix 43 extends from the front end of fixed folding member 42, and is substantially parallel to direction 17 and tangent to the path traveled by the outer surface of flat end plate 16 of each conveying head 14.

Figure 7:
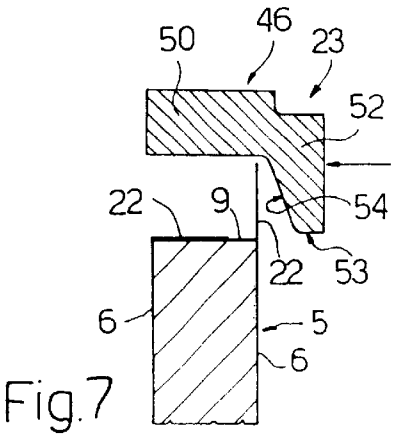
FIG. 7 shows an enlarged section along line VII—VII in FIG. 2.

Appendix 43 faces an opening 44 formed through plate 19 to permit the passage of an arm 45 of a rocker 46 forming part of folding device 23 Rocker arm 46 is hinged to a fixed central pin 47 fitted to a plate 48 integral with plate 19 and located downstream from opening 44 in direction 17. Rocker arm 46 rotates about a fixed axis 49 parallel to axis 12, and comprises a further arm 50 extending to the side of plate 19 and to the side of and through path P. Arm 45 is movable through opening 44 and in a plane substantially tangent to the relative end of groups 3, and comprises, on the side facing axis 12, a folding edge 51 for successively engaging and folding the outer tab 22 of each tubular wrapping 5 onto the relative end of groups 3. As shown more clearly in FIG. 7, the surface of arm 50 facing conveying heads 14 has a longitudinal rib 52, which extends along an edge of arm 50 facing axis 12, has an end surface 53 movable along a plane tangent to the relative end of relative group 3, and is defined outwards, i.e. on the opposite side to axis 12, by a flat surface transverse to surface 53 and defining a folding edge 54 for successively engaging and folding the inner tab 22 (i.e. the one coplanar with flat plate 16 of relative conveying head 14) of each tubular wrapping 5 onto the relative end of relative group 3 and into a position overlapping relative outer tab 22.

The two folding edges 51 and 54 are separated by a distance, measured along path P, equal to the distance between two corresponding points on plates 16 of two adjacent conveying heads 14, so that, when folding edge 51 acts on one tubular wrapping 5—hereinafter referred to as 5*a*—carried by one conveying head 14—hereinafter referred to as 14*a*—folding edge 54 acts on a tubular wrapping 5*b* carried by a conveying head 14*b* immediately downstream from conveying head 14*a* in direction 17.

Rocker arm 46 performs about axis 49 a swing whose active stroke moves folding edges 51 and 54 from a noninterference rest position (FIG. 1)—in which neither of edges 51 and 54 interferes with path P, and edge 51 is located outwards of, and edge 54 inwards of, path P—to at interference work position (FIG. 4)—in which edges 51 and 54 are substantially aligned along path P, edge 51 maintains folded an outer tab 22 of a tubular wrapping 5*a* carried by a conveying head 14*a,* and edge 54 maintains forded an inner tab 22 of a tubular wrapping 5*b* carried by a conveying head 14*b*.

Rocker arm 46 is swung between said work and rest positions by a crank 55, which is integral with rocker arm 46, rotates with rocker arm 46 about axis 49, and forms part of an articulated parallelogram 56, which in turn forms part of folding device 23, is activated by motor 26, and, in addition to crank 55, comprises crank 29, and a connecting rod 57 connected in rotary manner at one end to pin 32 and at the other end to a pin 58 parallel to pin 30 and connected integrally to a free end of crank 55.

Wrapping unit 2 also comprises a pressure device 59 located between folding devices 20 and 23, substantially at opening 44, and in turn comprising a flat wall defined by a pad 60 located laterally, in the direction of axis 12, with respect to plate 19, and which engages the outer major wall 6 of each tubular wrapping 5 engaging folding station 24 in a position facing folding edge 51. More specifically, pad 60 engages the portion of outer major wall 6 located between plate 19 and the relative end of relative group 3, i.e. the portion between plate 19 and the join of the relative outer major tab 22.

Pad 60 is movable, firstly, from a rest position (FIG. 4) in which pad 60 is located outwards of path P, to a work position in which pad 60 is tangent to path P and parallel to plate 16 of a conveying head 14 at the input of folding station 24, and secondly in such a manner as to remain parallel to said plate 16 and contacting the outer major wall 6 of relative tubular wrapping 5 as wrapping 5 is fed along the portion of folding station 24 extending along arm 45 of rocker arm 46. These movements—which, at all times, are the resultant of a linear movement of pad 60 in an instantaneous radial direction with respect to axis 12, anti of rotation of pad 60 about an instantaneous axis parallel to axis 12—are imparted to pad 60 by an actuating device 61, which comprises an articulated polygon 62 defined, in addition to pad 60, by two powered arms 63 and 64 fitted to the frame (not shown) of packing machine 1 to rotate about axis 40, and of which arm 63 is hinged to one end of pad 60, while arm 64 is connected to the other end of pad 60 by the interposition of a hinge lever 65. In the example shown, arms 63 and 64 form part of respective rocker arms 66 and 67, which are hinged about axis 40 and fitted, at the opposite ends to respective arms 63 and 64, with respective tappets (not shown) cooperating with respective cams (not shown) on wrapping wheel 11.

Operation of wrapping unit 2 will now be described with reference to one conveying head 14 as regards folding station 21 and an input portion of folding station 24, and with reference to two adjacent conveying heads 14*a* and 14*b* as regards an end portion of folding station 24.

Figure 1:
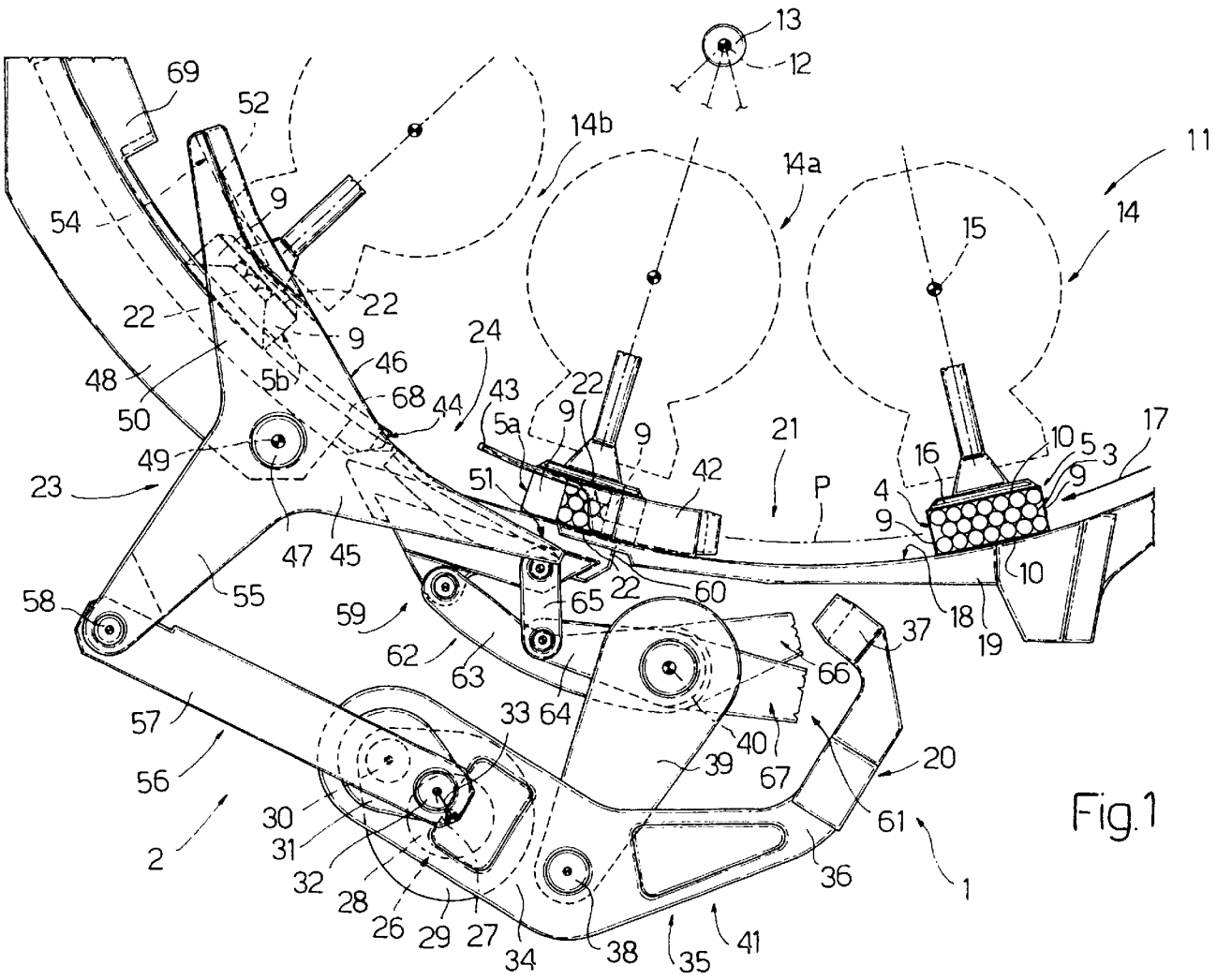
FIGS. 1 to 5 show schematic lateral elevations, with parts removed for clarity, of a preferred embodiment of the wrapping unit according to the present invention in different operating positions.
Figure 2:
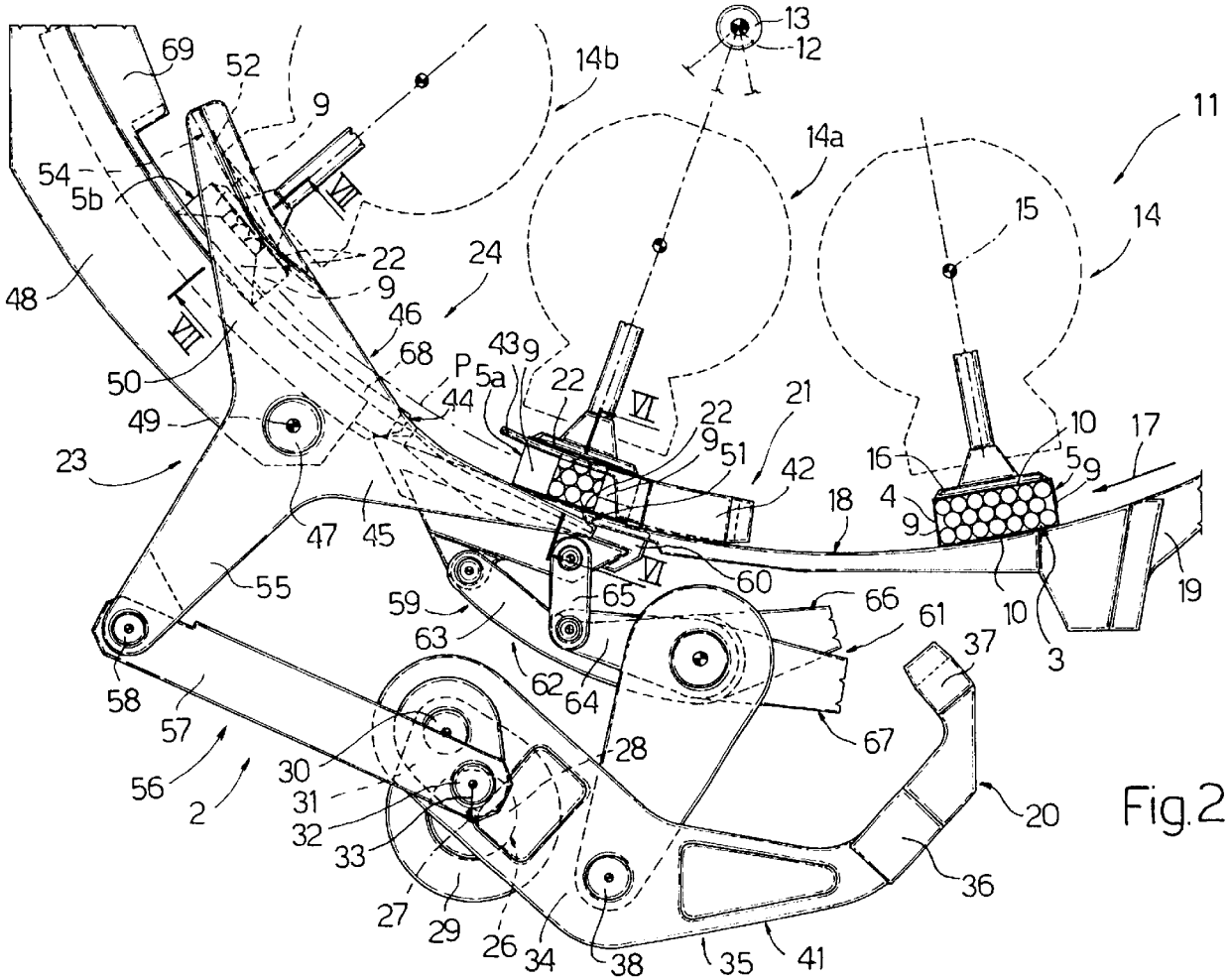
Figure 3:
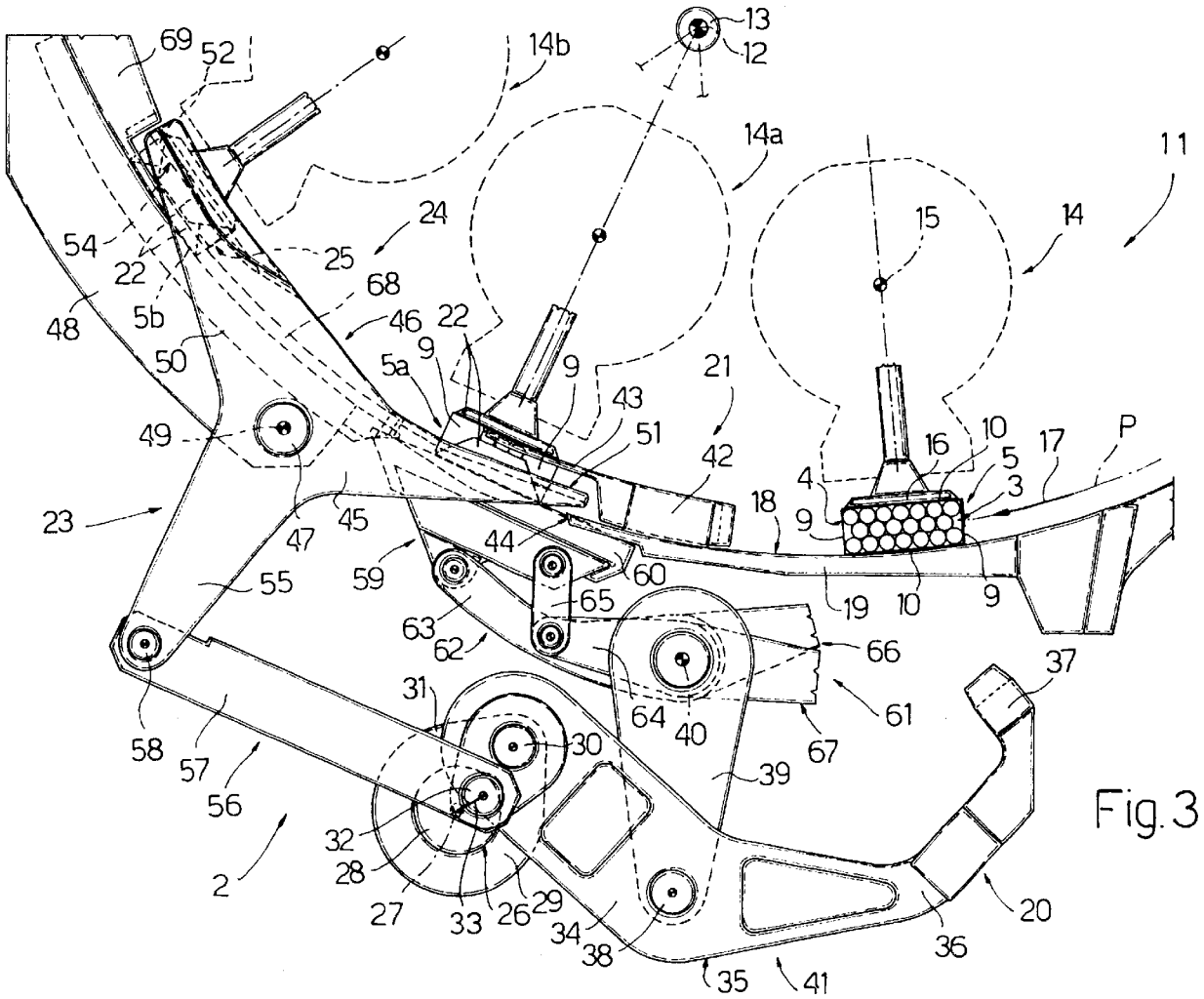

With reference to FIG. 1, when the conveying head 14 considered (the one to the right in FIG. 1) nears folding station 21 along path P in direction 17, the relative tubular wrapping 5 is fed, together with relative group 3, along channel 18 and is maintained contacting relative plate 16 by plate 19 sliding against the intermediate portion of outer major wall 6 of tubular wrapping 5. At the same time, as shown in FIGS. 1, 2 and 3, movable folding member 37 is moved into the rest position by motor 26 via articulated parallelogram 41. When the conveying head 14 considered begins to engage folding station 21 (FIG. 4), movable folding member 37 is reversed from the rest position to the work position; in the course of which movement, movable folding member 37 first reaches and travels along channel 18 so as to engage the rear short side 9 of relative tubular wrapping 5 and fold the short side 9 forward (FIG. 5) onto the relative free end of relative group 3. As soon as the rear short side 9 is folded, and before movable folding member 37 reaches its final position (FIG. 5), the front short side 9 encounters and is folded by fixed folding member 42 onto the relative end of relative group 3 to define the two tabs 22. Finally, movable folding member 37 is arrested in the work position substantially contacting fixed folding member 42 to enable the folded rear short side 9 to pass beneath fixed folding member 42.

At this point, as shown in FIG. 1, in which the conveying head 14 considered is now the central conveying head 14 indicated 14*a,* movable folding member 37 withdraws from path P into the rest position, while conveying head 14*a* and relative tubular wrapping 5*a* move into position in front of opening 44 and enter folding station 24 with short sides 9 maintained in the folded position by appendix 43 of fixed folding member 42. Just before this takes place (FIG. 5), pad 60 of pressure device 59 is in the rest position, as is rocker arm 46, the folding edges 51 and 54 of which are located on opposite sides of and outwards of channel 18

As tubular wrapping sa enters folding station 24 (FIG. 1), i.e. begins moving into position facing folding edge 51, actuating device 61 moves pad 60 into the work position contacting the outer major wall 6 of tubular wrapping 5*a,* and into a position parallel to the position assumed, at that moment, by plate 16 of conveying head 14*a,* so as to flatten the outer major wall 6 curved outwards by contact with plate 19. Subsequently, for as long as outer tab 22 of tubular wrapping 5*a* remains facing folding edge 51 (FIGS. 1 to 3), pad 60 is moved by actuating device 61 so as to remain contacting outer major wall 6 and parallel to the position assumed at each moment by plate 16 of conveying head 14*a*.

Figure 4:
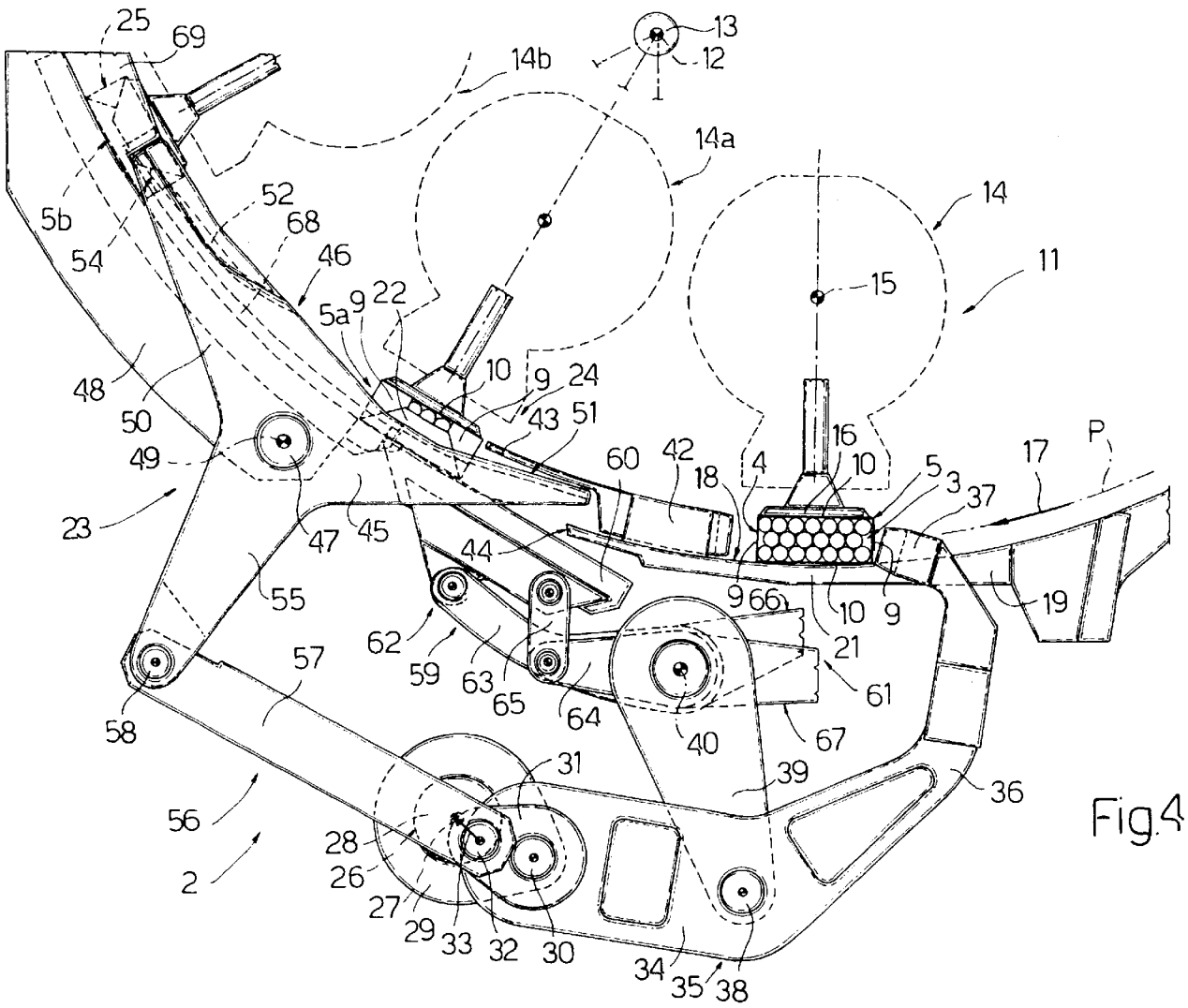

At the same time, motor 26 begins moving rocker arm 46 into the work position (FIG. 1) so that folding edge 51 engages outer tab 22 of tubular wrapping 5*a* through opening 44 and gradually folds outer tab 22 towards the relative end of group 3 and onto the two already folded short sides 9. Outer tab 22 is folded completely before tubular wrapping 5*a* leaves appendix 43 and begins leaving opening 44, and without engaging appendix 43, which, given its transverse dimensions, remains within the group 3 end space not covered by the folded outer tab 22. As wrapping 5*a* leaves opening 44, the folded outer tab 22 is inserted beneath a tooth 68, which projects inwards from plate 19, is located downstream from opening 44, and provides for keeping outer tab 22 folded until the end of tubular wrapping 5*a* is fully closed. At the same time, pad 60 releases tubular wrapping 5*a* and moves into the rest position (FIGS. 4 and 5).

As the above steps are being performed to fold tab 22 of tubular wrapping 5*a,* a tubular wrapping 5*b*—carried by conveying head 14*b* immediately downstream from conveying head 14*a* in direction 17, and having an outer tab 22 already folded as described above relative to tubular wrapping 5*a* and maintained folded by tooth 68—gradually moves into position (FIG. 1) in front of folding edge 54, which, as rocker arm 46 (FIGS. 2, 3 and 4) moves into the work position, gradually folds the inner tab 22 of tubular wrapping 5*b* onto the already folded outer tab 22 without engaging tooth 68, and onto the relative end of group 3 to close the end of tubular wrapping 5*b* completely and obtain a complete wrapping 25.

At the output of folding station 24, the complete wrapping 25 is fed by relative conveying head 14*b* beneath a tooth 69 coplanar with but wider than tooth 68, and which keeps tabs 22 in the folded position.

What is claimed is:

1. A method of closing the ends of tubular wrappings enclosing respective groups of cigarettes, each tubular wrapping (5) including a first major wall and a second major wall (6), a first minor wall and a second minor wall (7) perpendicular to said major walls (6), and at least one substantially rectangular-section tubular end portion (8) projecting axially with respect to the relative said group (3), the tubular end portion (8) including two short sides (9) coplanar with respective said minor walls (7), and two long sides (10) coplanar with respective said major walls (6), the method comprising:

folding the short sides (9) of each tubular wrapping (5) onto the relative said group (3) to define on the relative said long sides (10) a first tab and a second tab (22) coplanar with said first major wall and said second major wall (6) respectively;

folding the tabs (22) successively onto the relative said group (3), the tabs being folded towards each other such that when folding each said tab (22), the major wall (6) that is coplanar with tab (22) being folded is maintained parallel to and contacting a respective flat supporting wall (16, 60);

maintaining a first said supporting wall (16) in contact with said first major wall (6); and moving a second said supporting wall (60) between a contact position contacting said second major wall (6) and a rest position.

2. The method of claim 1, further comprising feeding the tubular wrapping along a path (P) parallel to said major walls (6) wherein said two tabs (22) are folded as the relative said tubular wrapping (5) is fed along the path (P), both said tabs (22) being folded successively by a single rocker arm (46) mounted to swing about a hinge axis (49) crosswise to said path (P) and comprising two folding arms (45, 50) located on opposite sides of said hinge axis (49), each folding arm (45, 50) having a respective folding edge (51; 54) for a respective said tab (22), said rocker arm (46) being swung about said hinge axis (49) so that each said folding edge (51; 54) interferes with said path (P) in time with said tubular wrappings (5) traveling along the path (P).

3. The method of claim 2, wherein said path (P) is an annular path.

4. The method of claim 3, further comprising feeding said tubular wrappings (5), together with the relative groups (3), continuously in a given traveling direction (17), and by means of respective conveying heads (14) on a wrapping wheel (11) of a cigarette packing machine (1), along said annular path (P), which extends about a rotation axis (12) of said wrapping wheel (11) and through a first and a second folding station (21, 24);

positioning each tubular wrapping (5) on the relative said conveying head (14) with a longitudinal axis of the tubular wrapping parallel to said rotation axis (12);

positioning said minor walls (7) substantially radially with respect to said rotation axis (12), said short sides (9) of each said tubular end portion (8) being folded onto the relative said group (3) when traveling through said first folding station (21), and said tabs (22) being folded successively onto the relative said group (3) and one towards the other when traveling through said second folding station (24).

5. The method of claim 4, wherein for each said tubular wrapping (5), a first said supporting wall (16) is a wall integral with a relative said conveying head (14), whereas a second said supporting wall (60) is common to said conveying heads (14), and is located at said second folding station (24), the method further comprising:

moving the second said supporting wall (60) towards said annular path (P) and into said contact position when folding each said second tab (22); and moving the second said supporting wall (60) when folding each said second tab (22), so as to keep the second supporting wall (60) constantly parallel to the relative first supporting wall (16).

6. The method of claim 4, wherein said hinge axis (49) is located outwards of said annular path (P) and is parallel to said rotation axis (12), said rocker arm (46) being common to all said conveying heads (14).

7. The method of claim 6, wherein said folding edges (51, 54) are separated by a distance substantially equal to a distance between two adjacent said conveying heads (14*a*, 14*b*) along said annular path (P), the method further comprising:

causing said folding edges (51, 54) to interfere with said annular path (P) inside said second folding station (24), so that a first (51) of said folding edges (51, 54) folds said first tab (22) of one of said tubular wrappings (5) carried by a first said conveying head (14*a*), and, simultaneously, a second (54) of said folding edges (51, 54) folds a said second tab (22) of a said tubular wrapping (5) carried by a second said conveying head (14*b*) adjacent to said first conveying head (14*a*).

8. The method of claim 7, wherein said first conveying head (14*a*) and said first folding edge (51) are located upstream from said second conveying head (14*b*) and said second folding edge (54) respectively in said traveling direction (17).

9. The method of claim 4, wherein said first folding station (21) is located upstream from said second folding station (24) in said traveling direction (17).

10. The method of claim 9, wherein said short sides (9) of each said tubular wrapping (5) are folded by engaging a first of said short sides (9) by means of a movable folding member (37), and a second of said short sides (9) by means of a fixed folding member (42), said fixed folding member (42) and said movable folding member (37) being located at said first folding station (21) and being common to all said conveying heads (14), and said first short side (9) being located upstream from the respective said second short side (9) in said traveling direction (17).

11. The method of claim 10, wherein said fixed folding member (42) is located along said annular path (P), the method further comprising moving said movable folding member (37) along said annular path (P) and in said traveling direction (17) firstly with respect to said tubular wrapping (5) to fold the relative first short side (9), and then together with said tubular wrapping (5) and into substantial contact with said fixed folding member (42) to keep the first short side (9) in the folded position.

12. A method of closing the ends of tubular wrappings enclosing respective groups of cigarettes, each tubular wrapping (5) including a first major wall and a second major wall (6), a first minor wall and a second minor wall (7) perpendicular to said major walls (6), and at least one substantially rectangular-section tubular end portion (8) projecting axially with respect to the relative said group (3), the tubular end portion (8) including two short sides (9) coplanar with respective said minor walls (7), and two long sides (10) coplanar with respective said major walls (6), the method comprising:

feeding the tubular wrapping (5) in a traveling direction along a path (P) parallel to said major walls (6);

folding the short sides (9) of each tubular wrapping (5) onto the relative said group (3) to define on the relative said long sides (10) a first tab and a second tab (22) coplanar with said first major wall and said second major wall (6) respectively; and folding the tabs (22) successively onto the relative said group with a single rocker arm (46) mounted to swing about a hinge axis (49) crosswise to said path (P) and comprising two folding arms (45, 50) located on opposite sides of said hinge axis (49) the folding arms each having a respective folding edge (51; 54) for a respective said tab (22), said rocker arm (46) being swung about said hinge axis (49) so that each said folding edge (51; 54) interferes with said path (P) in time with said tubular wrapping (5) traveling along the path (P).

13. The method of claim 12, wherein said path (P) is an annular path.

14. The method of claim 13, further comprising feeding said tubular wrappings (5), together with the relative groups (3), continuously in said traveling direction (17), and by means of respective conveying heads (14) on a wrapping wheel (11) of a cigarette packing machine (1), along said annular path (P), which extends about a rotation axis (12) of said wrapping wheel (11) and through a first and a second folding station (21, 24);

positioning each tubular wrapping (5) on the relative said conveying head (14) with a longitudinal axis of the tubular wrapping parallel to said rotation axis (12);

positioning said minor walls (7) substantially radially with respect to said rotation axis (12), said short sides (9) of each tubular wrapping (5) being folded onto the relative said group (3) when traveling through said first folding station (21), said tabs (22) being folded successively onto the relative said group (3) and one towards the other when traveling through said second folding station (24).

15. The method of claim 14, wherein said hinge axis (49) is located outwards of said annular path (P) and is parallel to said rotation axis (12), said rocker arm (46) being common to all said conveying heads (14).

16. The method of claim 15, wherein said folding edges (51, 54) are separated by a distance substantially equal to a distance between two adjacent said conveying heads (14*a*, 14*b*) along said annular path (P), the method comprising:

causing said folding edges (51, 54) to interfere with said annular path (P) inside said second folding station (24), so that a first (51) of said folding edges (51, 54) folds said first tab (22) of a said tubular wrapping (5*a*) carried by a first said conveying head (14*a*), and, simultaneously, a second (54) of said folding edges (51, 54) folds said second tab (22) of a said tubular wrapping (5*b*) carried by a second said conveying head (14*b*) adjacent to said first conveying head (14*a*).

17. The method of claim 16, wherein said first conveying head (14*a*) and said first folding edge (51) are located upstream from said second conveying head (14*b*) and said second folding edge (54) respectively in said traveling direction (17).

18. The method of claim 14, wherein said first folding station (21) is located upstream from said second folding station (24) in said traveling direction (17).

19. The method of claim 14, wherein, for each said tubular wrapping (5), said first supporting wall (16) is a wall integral with a relative said conveying head (14), whereas said second supporting wall (60) is common to said conveying heads (14), is moved towards said annular path (P) and into said contact position when folding each said second tab (22), and is moved, when folding each said second tab (22), so as to keep the second supporting wall (60) constantly parallel to the relative first supporting wall (16).

20. The method of claim 12, wherein said short sides (9) of each said tubular wrapping (5) are folded by engaging a first of said short sides (9) by means of a movable folding member (37), and a second of said short sides (9) by means of a fixed folding member (42), each said tubular wrapping (5) being brought into engagement with said fixed folding member (42) and said movable folding member (37), and said first short side (9) being located upstream from the respective said second short side (9) in said traveling direction (17).

21. The method of claim 20, wherein said fixed folding member (42) is located along said path (P), the method further comprising moving said movable folding member (37) along said path (P) and in said traveling direction (17) firstly with respect to said tubular wrapping (5) to fold the relative first short side (9), and then together with said tubular wrapping (5) and into substantial contact with said fixed folding member (42).

22. The method of claim 12, wherein, at least when folding each said tab (22), said major wall (6) coplanar with said tab (22) is maintained parallel to and contacting a respective flat supporting wall (16; 60).

23. The method of claim 22, wherein a first said supporting wall (16) is maintained permanently contacting said first major wall (6), whereas a second said supporting wall (60) is a movable wall, which is moved to and from a contact position contacting said second major wall (6).

24. A unit for closing the ends of tubular wrappings enclosing respective groups of cigarettes, each tubular wrapping (5) comprising a first and a second major wall (6), a first and a second minor wall (7) perpendicular to said major walls (6), and at least one substantially rectangular-section tubular end portion (8) projecting axially with respect to the relative said group (3) and in turn comprising two short sides (9) coplanar with respective said minor walls (7), and two long sides (10) coplanar with respective said major walls (6); the unit comprising:

first folding means (37, 42) for folding said short sides (9) of each tubular wrapping (5) onto the relative said group (3) to define a tab (22) on each said long side (10);

second folding means (46) for folding said tabs (22) successively onto the relative said group (3) and one towards the other;

two flat supporting walls (16, 60);

actuating means (62, 66, 67) for maintaining said two flat supporting walls (16, 60) parallel to each other and each contacting a respective said major wall (6), at least when folding the tab (22) coplanar with said major wall (6);

a first folding station and a second folding station (21, 24) located successively along a path (P):

conveying means (11) for feeding said tubular wrappings (5) successively along said given path (P) and in a given traveling direction (17), said conveying means (11) comprising a number of conveying heads (14), each for housing a respective said tubular wrapping (5), each tubular wrapping (5) being positioned on the relative said conveying head (14) with a longitudinal axis of the tubular wrapping crosswise to said traveling direction (17), wherein a first said supporting wall (16) is a wall of said conveying head (14), and is positioned parallel to and contacting said first major wall (6) coplanar with a first said tab (22); and a second said supporting wall (60) is a movable wall common to all the conveying heads (14), and said actuating means (62, 66, 67) being connected to said second supporting wall (60) to move the second supporting wall (60) to and from a contact position contacting a said tubular wrapping (5) located at said second folding station (24), and to position said second supporting wall (60), in said contact position, contacting said second major wall (6) coplanar with a respective second said tab (22).

25. The unit of claim 24, wherein said second folding means (46) comprise a single rocker arm (46), which folds both said tabs (22) as the relative tubular wrapping (5) is fed through said second folding station, said rocker arm (46) being mounted to rotate about a hinge axis (49) crosswise to said path (P), and comprising two folding arms (45, 50) located on opposite sides of said hinge axis (49) and each folding arm having a respective folding edge (51; 54) for a respective said tab (22), and first actuating means (26, 56) for swinging said rocker arm (46) so that said folding edges (51, 54) interfere with said path (P) in time with each said conveying head (14) traveling along the path (P).

26. The unit of claim 25, wherein said conveying means (11) comprise a wrapping wheel (11) mounted to rotate continuously about a rotation axis (12) crosswise to said path (P), and a number of said conveying heads (14) equally spaced about said rotation axis (12), said path (P) being an annular path (P) extending about said rotation axis (12), and each said conveying head (14) being so formed as to support the relative said tubular wrapping (5) with the relative said minor walls (7) positioned substantially radially with respect to said rotation axis (12).

27. The unit of claim 26, wherein said actuating means (62, 66, 67) keep said second supporting wall (60) in said contact position and parallel to said first supporting wall (16) of a tubular wrapping (5) located in said second folding station (24) when folding said second tab (22) of said tubular wrapping (5) and as the tubular wrapping (5) is fed along at least part of said second folding station (24).

28. The unit of claim 26, wherein said hinge axis (49) is located in a fixed position outwards of said annular path (P), and is parallel to said rotation axis (12), said rocker arm (46) being common to all said conveying heads (14).

29. The unit of claim 28, wherein said folding edges (51, 54) are separated by a distance substantially equal to a distance between two adjacent said conveying heads (14*a*, 14*b*) along said path (P).

30. The unit of claim 28, wherein said first actuating means (26, 56) comprise a first articulated quadrilateral (56) in turn comprising a powered crank (29) powered to rotate about a first motor axis (27) parallel to said rotation axis (12), a driven crank (55) integral with said rocker arm (46) and rotating with the rocker arm (46) about said hinge axis (49), and a connecting rod (57) connecting said cranks (29, 55) to each other.

31. The unit of claim 30, further comprising one motor (26) for powering both said powered cranks (33, 29), said first and second motor axes (27) being coincident with each other.

32. The unit of claim 24, wherein said first folding station (21) is located upstream from said second folding station (24) in said traveling direction (17).

33. The unit of claim 24, wherein said first folding means (37, 42) comprise a movable folding member (37) for folding a first of said short sides (9), a fixed folding member (42) for folding a second of said short sides (9), and second actuating means (26, 41) for moving said movable folding member (37) to and from a position substantially contacting said fixed folding member (42), said movable and fixed folding members (37, 42) being located at said first folding station (21), and being common to all said conveying heads (14), and said movable folding member (37) being located upstream from said fixed folding member (42) in said traveling direction (17).

34. The unit of claim 33, wherein said second actuating means (26, 41) comprise a second articulated quadrilateral (41) in turn comprising a further powered crank (33) powered to rotate about a second motor axis (27) parallel to said rotation axis (12), a further driven crank (39) rotating about a fixed axis (40) parallel to said second motor axis (27), and a further connecting rod (34) connecting said further cranks (33, 39) and integral with said movable folding member (37).

35. The unit of claim 34, wherein said fixed axes (40) are coincident with each other.

36. The unit of claim 24, wherein said actuating means (62, 66, 67) comprise an articulated polygon (62) in turn comprising two powered cranks (63, 64), a first connecting rod defined by a pad (60) defining said second supporting wall (60) and hinged to a first said crank (63), and a second connecting rod (65) connecting said pad (60) to a second said crank (64).

37. The unit of claim 36, wherein said two powered cranks (63, 64) are mounted to rotate about a same fixed axis (40) parallel to said rotation axis (12).

38. A unit for closing the ends of tubular wrappings enclosing respective groups of cigarettes, each tubular wrapping (5) comprising a first and a second major wall (6), a first and a second minor wall (7) perpendicular to said major walls (6), and at least one substantially rectangular-section tubular end portion (8) projecting axially with respect to the relative said group (3) and in turn comprising two short sides (9) coplanar with respective said minor walls (7), and two long sides (10) coplanar with respective said major walls (6); the unit comprising:

first folding means (37, 42) located at a first folding station (21) to fold said short sides (9) of each tubular wrapping (5) onto the relative said group (3) to define a tab (22) on each said long side (10);

first actuating means (26, 41) for actuating said first folding means (37, 42);

second folding means (46) located at a second folding station (24) to fold said tabs (22) successively onto the relative said group (3) and one towards the other;

second actuating means (26, 56) for actuating said second folding means (46); and conveying means (11) for feeding said tubular wrappings (5) successively and continuously in a given traveling direction (17) and along a path (P) extending through said first and said second folding station (21, 24); wherein said second folding means (46) comprise a single rocker arm (46), which successively folds both said tabs (22) of each said tubular wrapping (5) as the tubular wrapping (5) is fed through said second folding station (24), said rocker arm (46) being mounted to rotate about a hinge axis (49) crosswise to said path (P), and comprising two folding arms (45, 50) located on opposite sides of said hinge axis (49) and each folding arm having a respective folding edge (51; 54) for a respective said tab (22), and said second actuating means (26, 56) swinging said rocker arm (46) so that said folding edges (51, 54) interfere with said path (P) in time with said conveying means (11).

39. The unit of claim 38, further comprising two flat supporting walls (16, 60), each of which is maintained parallel to and contacting a respective said major wall (6) at least when folding the relative said tab (22).

40. The unit of claim 39, wherein a first said supporting wall (16) is a fixed wall of said conveying head (14), which supports a relative said tubular wrapping (5) with said first major wall (6) parallel to and contacting the relative said fixed wall and coplanar with a respective first said tab (22), a second said supporting wall (60) is a movable wall common to all the conveying heads (14), and third actuating means (62, 66, 67) are provided to move said second supporting wall (60) to and from a contact position contacting said tubular wrapping (5) located at said second folding station (24), said second supporting wall (60) being positioned, in said contact position, contacting said second major wall (6) and coplanar with a respective second said tab (22).

41. The unit of claim 40, wherein third actuating means (62, 66, 67) keep said second supporting wall (60) in said contact position and parallel to said first supporting wall (16) of a tubular wrapping (5) located in said second folding station (24) when folding said second tab (22) of said tubular wrapping (5) and as the tubular wrapping (5) is fed along at least part of said second folding station (24).

42. The unit of claim 41, wherein said third actuating means (62, 66, 67) comprise an articulated polygon (62) in turn comprising a first and a second powered crank (63, 64), a first connecting rod defined by a pad (60) defining said second supporting wall (60) and hinged to said first crank (63), and a second connecting rod (65) connecting said pad (60) to said second crank (64).

43. The unit of claim 42, wherein said two powered cranks (63, 64) are mounted to rotate about a same fixed axis (40) parallel to said rotation axis (12).

44. The unit of claim 38, wherein said conveying means (11) comprise a number of conveying heads (14), each for housing a respective said tubular wrapping (5) positioned with a longitudinal axis of the tubular wrapping crosswise to said traveling direction (17).

45. The unit of claim 44, wherein said first folding means (37, 42) comprise a movable folding member (37) for folding a first of said short sides (9), and a fixed folding member (42) located along said path (P) to fold a second of said short sides (9), said first actuating means (26, 41) moving said movable folding member (37) along said path (P) to and from a position substantially contacting said fixed folding member (42), said movable and fixed folding members (37, 42) being located at said first folding station (21), and being common to all said conveying heads (14), and said movable folding member (37) being located upstream from said fixed folding member (42) in said traveling direction (17).

46. The unit of claim 45, wherein said first actuating means (26, 41) comprise a second articulated quadrilateral (41) in turn comprising a further powered crank (33) powered to rotate about a motor axis (27) parallel to said rotation axis (12), a further driven crank (39) rotating about a fixed axis (40) parallel to said motor axis (27), and a further connecting rod (34) connecting said further cranks (33, 39) and integral with said movable folding member (37).

47. The unit of claim 38, wherein said conveying means (11) comprise a wrapping wheel (11) mounted to rotate continuously about a rotation axis (12) crosswise to said path (P), and a number of said conveying heads (14) equally spaced about said rotation axis (12), said path (P) being an annular path (P) extending about said rotation axis (12), and each said conveying head (14) being so formed as to support the relative said tubular wrapping (5) with a relative longitudinal axis parallel to said rotation axis (12), and with the relative said minor walls (7) positioned substantially radially with respect to said rotation axis (12).

48. The unit of claim 47, wherein said hinge axis (49) is located in a fixed position outwards of said annular path (P), and is parallel to said rotation axis (12), said rocker arm (46) being common to all said conveying heads (14).

49. The unit of claim 48, wherein said second actuating means (26, 56) comprise a first articulated quadrilateral (56) in turn comprising a powered crank (29) powered to rotate about a motor axis (27) parallel to said rotation axis (12), a driven crank (55) integral with said rocker arm (46) and rotating with the rocker arm (46) about said hinge axis (49), and a first connecting rod (57) connecting said cranks (29, 55) to each other.

50. The unit of claim 49, further comprising one motor (26) for powering both said powered cranks (29, 33), said motor axes (27) of said two powered cranks (29, 33) being coincident with each other.

51. The unit of claim 47, wherein said folding edges (51, 54) are separated by a distance substantially equal to a distance between two adjacent said conveying heads (**14*a*, 14*b***) along said annular path (P).

52. The unit of claim 38, wherein said first folding station (21) is located upstream from said second folding station (24) in said traveling direction (17).

* * * * *

UNITED STATES PATENT AND TRADEMARK OFFICE

CERTIFICATE OF CORRECTION

PATENT NO. : 6,601,369 B2
DATED : August 5, 2003
INVENTOR(S) : Spatafora et al.

It is certified that error appears in the above-identified patent and that said Letters Patent is hereby corrected as shown below:

Title page,
Item [73], "G.D. Societa'"should be -- G.D. Societa' --

Column 7,
Line 17, "with tab (22)." should be -- with a tab (22). --

Signed and Sealed this

Eighteenth Day of November, 2003

JAMES E. ROGAN
*Director of the United States Patent and Trademark Office*

UNITED STATES PATENT AND TRADEMARK OFFICE

CERTIFICATE OF CORRECTION

PATENT NO. : 6,601,369 B2
DATED : August 5, 2003
INVENTOR(S) : Spatafora et al.

It is certified that error appears in the above-identified patent and that said Letters Patent is hereby corrected as shown below:

Title page,
Item [73], "G.D. Societa'" should be -- G.D Societa' --

Column 7,
Line 17, "with tab (22)." should be -- with a tab (22). --

This certificate supersedes Certificate or Correction issued November 18, 2003.

Signed and Sealed this

Twenty-first Day of December, 2004

JON W. DUDAS
*Director of the United States Patent and Trademark Office*